United States Patent [19]

Zaehringer

[11] 4,234,110

[45] Nov. 18, 1980

[54] DEVICE FOR FOLDING-DOWN AND PRESSING JACKET COLLARS

[75] Inventor: André Zaehringer, Strasbourg-Meinau, France

[73] Assignee: Vestra-Union, S.A., Paris, France

[21] Appl. No.: 952,253

[22] Filed: Oct. 17, 1978

[30] Foreign Application Priority Data

Oct. 17, 1977 [FR] France ..... 77 31871

[51] Int. Cl.[3] ..... D06C 15/02

[52] U.S. Cl. ..... 223/57

[58] Field of Search ..... 223/37, 52, 52.1, 57; 38/13, 109, 110

[56] References Cited

U.S. PATENT DOCUMENTS 1,357,218 11/1920 Boyuls ..... 223/57

3,317,094 5/1967 Schmid ..... 223/57

4,004,720 1/1977 Cartabbia ..... 223/57

*Primary Examiner*—Louis Rimrodt

*Attorney, Agent, or Firm*—Young & Thompson

[57] ABSTRACT

The disclosure is of a device to facilitate the folding-down of jacket collars comprising in combination a lower support member for supporting a jacket to which an initially unfolded collar is attached, a lower plate which is pivotally mounted and controllable by a jack so that it swings down on to the jacket and then the upper edge of the lower plate forms a template against which the lower edge of the collar on the jacket can be located, an upper plate which is pivotally mounted and controllable by a jack so that it swings down and lies against the lower plate and a portion of the upper plate projects above the upper edge of the lower plate, the upper edge of the upper plate then forming a template for a fold line of the collar.

5 Claims, 1 Drawing Figure

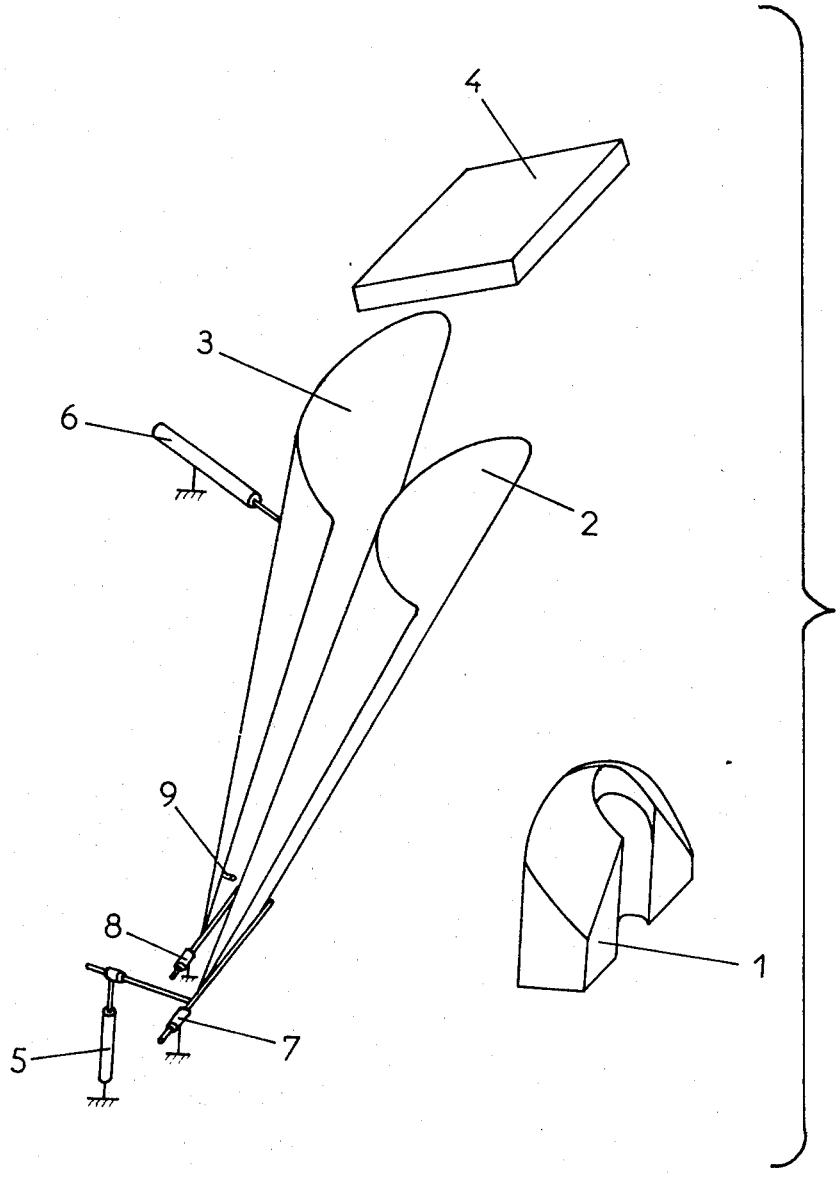
4
3
6
2
9
8
1
5
7

DEVICE FOR FOLDING-DOWN AND PRESSING JACKET COLLARS

INTRODUCTION AND BACKGROUND OF THE INVENTION

This invention relates to an automatic device to facilitate the folding-down of jacket collars.

In practice the operation of the folding-down of a jacket collar is usually effected in two stages, that is to say a first stage of "building" the collar, and a second stage of folding-down and ironing the collar. The "building" includes preliminary fixing of the collar by means of a tacking thread. After the "building" the jacket collar is manually located upon a press, being folded upon itself, usually at about 25 mm from the lower edge of the collar, before the actual ironing or pressing.

This operation of folding-down, because it comprises the said two stages, necessitates a relatively long working time, and, moreover, the folding-down of the collar is very intricate and requires much dexterity and a special aptitude from the operator.

The present invention is therefore intended to provide an automatic device to facilitate the folding-down of jacket collars.

BRIEF SUMMARY OF THE INVENTION

According to the invention there is provided an automatic device to facilitate the folding-down of jacket collars, characterised in that it comprises a lower support member for supporting a jacket, two movable plates for use in locating a collar and then putting the collar into shape, and an upper member for the ironing or pressing of the collar.

FURTHER DESCRIPTION AND ADVANTAGES OF THE INVENTION

Preliminary "building" or manual manipulation and tacking or basting of the collar can thus be avoided, and the production of large numbers of jackets with accurately folded-down collars can be expedited.

How the invention may be put into practice will be better understood due to the following description which relates to a preferred manner of construction, given by way of non-limitative example, and explained with reference to the accompanying schematic drawing.

BRIEF DESCRIPTION OF THE DRAWING

In the said drawing the single FIGURE is a view in perspective of some of the components of an automatic device according to the invention.

DETAILED DESCRIPTION OF THE PREFERRED EMBODIMENT

The device illustrated in the accompanying drawing comprises a lower support member 1 for supporting a jacket. Two movable plates 2 and 3 serve as templates for putting a collar on the jacket into shape, and there is an upper member 4 for the ironing or pressing of the collar. The two plates 2 and 3 have shapes complementary to that of a part of the lower support member 1. The two plates 2 and 3 are controlled respectively by jacks 5 and 6. Moreover the upper plate 3 has a disposition or length greater than that of the plate 2, in a manner such as to project therebeyond by the distance provided for the folding of the collar, for example by about 25 mm±5 mm, when the two plates are applied to the support member 1. These plates 2 and 3 are pivoted at 7 and 8 respectively, and preferably are made of stainless steel or the like.

Between the plates 2 and 3, for example upon the upper plate 3, there is mounted a fixed limit switch 9 for limiting travel, which permits the control of the termination of the descent of the upper plate 3.

The upper edge of the lower plate 2 serves as a template for the regulating of the location of the collar, the latter being placed so that its lower edge coincides with the upper edge of the plate 2. The upper edge of the upper plate 3 forms a template which permits the folding-down of the said collar exactly at the predetermined distance from the lower edge of the collar.

The device according to the invention functions in the following manner:

After the positioning of a jacket upon the lower support member 1, the jack 5 for controlling the plate 2 is activated by means of a control button (not shown but known per se) and the plate 2 presses the jacket against the support member 1. Then the operator positions the jacket and collar in such a manner that the lower edge of the collar fits against the upper edge of the plate 2. The operator then activates the jack 6 for controlling the plate 3, in such a manner as to initiate the pivoting of this plate 3 on to the plate 2. On completion of this pivoting of the plate 3, the upper edge of this plate 3 extends above the upper edge of the plate 2, for example by 25 mm, and thus above the lower edge of the collar by 25 mm, that is to say by the predetermined distance for the folding-down of the collar of the jacket. When the plate 3 arrives at the end of its travel, on the plate 2, it initiates the closing of the switch 9, which permits the control of the termination of the descent of the plate 3. The operator then folds down the collar of the jacket, keeping the fold line along the upper edge of the upper plate 3, then he actuates another control button (not shown) permitting the descent of the member 4 with a view to the ironing or pressing of the collar.

In this manner it is possible to effect rapidly, and at little expense, the operation of the folding-down of a jacket collar, without preliminary tacking and with great precision.

It will be well understood that the invention is not limited to the manner of construction described with reference to and represented in the accompanying drawing, as modifications remain possible within the scope of protection of the invention as defined in the accompanying claims.

What is claimed is:

1. A device to facilitate the folding-down of jacket collars, comprising in combination a lower support member (1) for supporting a jacket to which an unfolded collar is attached, a lower plate (2) which is pivotally mounted (7) and controllable by a jack (5) so that it swings down on to the jacket and then the upper edge of the lower plate (2) forms a template against which the lower edge of the collar on the jacket can be located, an upper plate (3) which is pivotally mounted (8) and controllable by a jack (6) so that it swings down and lies against the lower plate (3) and a portion of the upper plate (3) projects above the upper edge of the lower plate (2), the upper edge of the upper plate (3) then forming a template for a fold line of the collar which is located by the lower plate (3), and a pressing or ironing upper member (4) movable to press or iron the said collar after the latter is folded down over the upper plate (3).

2. Apparatus to facilitate the folding-down of jacket collars, comprising a lower support member for supporting a jacket with the collar attached thereto, a lower plate movable into and out of contact with the jacket supported on said support member, said lower plate having an upper edge that serves as a template against which the lower edge of the collar can be located, an upper plate movable onto the lower plate, the upper plate having an upper edge disposed a substantial distance higher than said upper edge of said lower plate and that serves as a template over which said collar can be folded, and an upper member for ironing or pressing the collar folded over said upper plate.

3. A device as claimed in claim 2, said upper and lower plates being pivotally mounted on the device for vertical swinging movement about horizontal axes.

4. A device as claimed in claim 3, and fluid pressure jacks for swinging said upper and lower plates about said axes.

5. A device as claimed in claim 3, and a limit switch for limiting travel of said upper plate toward said lower plate.

* * * * *